US006772843B2

(12) United States Patent
Nice et al.

(10) Patent No.: US 6,772,843 B2
(45) Date of Patent: Aug. 10, 2004

(54) SEA-FLOOR PRESSURE HEAD ASSEMBLY

(75) Inventors: Sidney Basil Nice, Humble, TX (US); Freeman Lee Hill, Houston, TX (US); Ron D. Nelson, New Orleans, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/012,229

(22) Filed: Dec. 4, 2001

(65) Prior Publication Data

US 2002/0104660 A1 Aug. 8, 2002

Related U.S. Application Data

(60) Provisional application No. 60/251,292, filed on Dec. 5, 2000.

(51) Int. Cl.[7] ..... E21B 29/12

(52) U.S. Cl. ..... 166/368; 166/337; 166/339; 166/85.4

(58) Field of Search ..... 166/337, 339, 166/368, 85.4, 335

(56) References Cited

U.S. PATENT DOCUMENTS 4,325,409 A * 4/1982 Roberts ..... 137/596.14
4,718,495 A 1/1988 Lubitz et al.
4,951,745 A 8/1990 Gentry et al.
5,002,130 A * 3/1991 Laky ..... 166/351
5,775,420 A * 7/1998 Mitchell et al. ..... 166/85.4
6,024,172 A 2/2000 Lee
6,202,753 B1 * 3/2001 Baugh ..... 166/364

* cited by examiner

*Primary Examiner*—Thomas B. Will
*Assistant Examiner*—Thomas A Beach
(74) *Attorney, Agent, or Firm*—Darryl M. Springs; Keith R. Derrington

(57) ABSTRACT

A method for eliminating the presence of micro-annuluses associated with a subsea hydrocarbon producing wellbore for accurate gathering of data within the subsea hydrocarbon producing wellbore. The method involves using a sea floor pressure head assembly in conjunction with a subsea blow out preventer, where the sea floor pressure head assembly has an elongated tube with a stop ring formed thereon and an ambient pressure side. The blow out preventer is connected to the entrance of the subsea hydrocarbon producing wellbore, and includes an inflatable bladder and is connected to a hollow riser connected thereto.

27 Claims, 6 Drawing Sheets

SEA-FLOOR PRESSURE HEAD ASSEMBLY

RELATED APPLICATIONS

This application claims priority from co-pending U.S. Provisional Application No. 60/251,292, filed Dec. 5, 2000, the full disclosure of which is hereby incorporated by reference herein.

BACKGROUND OF THE INVENTION

1. Field of the Invention

The invention relates generally to the field of oil and gas well logging. More specifically, the present invention relates to a method and apparatus to enhance the accuracy of retrieving acoustical data gathered during sub-sea oil and gas well logging.

2. Description of Related Art

Numerous techniques, generally known as well logging, exist for collecting geological data from oil and/or gas wells, where the geological data is useful for locating potential hydrocarbon bearing reservoirs. Well logging is also used for estimating the capacity of the potential hydrocarbon bearing reservoirs. Many types of well logging practices exist. They include neutron logs, induction logs, and acoustic logs. In each of the aforementioned well logging techniques a well logging tool is deposited into the wellbore and travels through the well bore collecting geological data about the region surrounding the well bore. Generally the well logging tool produces a signal, either electrical, nuclear, or acoustical, which is directed into the area adjacent the well bore. The reflection or propagation of the emitted signal is then retrieved by the tool or by another piece of equipment suitably located. The retrieved signals are stored and analyzed in order to evaluate the potential for hydrocarbon production in the particular geological formation being analyzed, monitor reservoir performance, or to evaluate wellbore mechanical integrity.

Generally the well logging tool is inserted into the well bore attached to a wire line. The tool is raised and lowered by the wireline, and data is transmitted through the wireline for introducing signals to the well logging tool from the surface. The wire line can also transmit data recovered from within the well bore to the surface for collection and analysis. Because in most instances the bore hole pressure exceeds the ambient pressure, weighted wellbore fluid is used to overbalance or contain this pressure. As a secondary safety measure, a pressure containment apparatus, or pack off head, is often installed on the well during wireline operations. A typical pack off head includes a hard rubber insert with a passage where the wire line passes through the annulus. To seal around the wireline, the hard rubber insert is axially compressed, which reduces the cross sectional area of the passage. Reducing the cross sectional area of the passage causes the inner radius of the passage to fit snugly around the outer radius of the wire line, thus preventing fluid flow through the passage. Although the passage snugly seals around the outer radius of the wire line, the wire line is still able to freely traverse through the passage.

In acoustic well logging, acoustic waves are emitted from a transmitter source and travel through the casing, cement sheath, and geological formations that surround the well. Receivers are situated at predetermined locations and distances away from the acoustic source. The receivers are able to detect the waves and then measure the wave frequencies and velocities. Measurement of the wave frequencies and velocities can provide useful information regarding the potential for hydrocarbon production, reservoir performance, or wellbore mechanics.

As is well known in the art, additional well logging activities occur after an oil or gas well has been completed. Completing an oil or gas well involves inserting metal casing into an already drilled well bore. After the casing is inserted into the larger wellbore, an annular space is formed between the outer surface of the casing and the inner radius of the wellbore. Cement is then injected into this space thereby securing the casing into the wellbore and generally providing a sealing bond between the casing and the inner radius of the wellbore.

The casing extends into the well bore often in excess of 5000 feet, sometimes greater than 15,000 feet. Consequently the formation pressure of the fluid (either hydrocarbon or water) in the surrounding geological formation can be quite high. A drilling fluid or mud is maintained in the wellbore during drilling and cementing procedures at a density to provide an overbalanced condition to contain the formation pressures anticipated in the wellbore. After the cementing procedure is completed, and the formations are sealed off from the wellbore, heavy drilling mud is replaced in the casing in preparation for the final well completion of the well for production. The heavy drilling mud is replaced with a lighter weight fluid (completion fluid) that is pumped into the wellbore. When the heavy drilling mud inside of the casing is replaced with the lower specific gravity completion fluids, a pressure differential will result across the diameter of the casing. With reduced pressure on the inside of the casing, compared to the higher pressure on the outer surface of the casing, the casing will contract leaving a small void, termed a micro-annulus, between the outer surface of the casing and the cement that surrounds the casing. The presence of a micro-annulus alters the acoustic signal path which in turn affects the acoustic cement evaluation instruments that are used to measure the bonding condition of the cement to the pipe and to the formation.

It is possible to eliminate the micro-annulus affect if the inside of the casing is sufficiently pressurized to expand the casing up against the inside of the cement sheath simulating the drilling mud during cementing operations, while the cement bond log is performed. While this can currently be performed above ground, this is not the case with deepwater offshore or subsea wells. The current deepwater sea floor well head and riser configuration prevents the operators from pressurizing the inner casing without applying unacceptable pressure on the riser.

Therefore, a method or an apparatus is desired that enables pressurizing the inside of an offshore or subsea oil and/or gas well casing with sufficient pressure to eliminate any micro-annulus voids that may exist between the casing and the cement sheath, without resulting in an unacceptable pressure being exposed to the drilling riser.

BRIEF SUMMARY OF THE INVENTION

A seafloor pressure head assembly for use in hydrocarbon producing wellbore wireline operations in combination with a blow out preventer, where the blow out preventer is located at the entrance to a subsea hydrocarbon producing wellbore. Formed within an inner axial passage of the blow out preventer is an inflatable bladder. Also attached to the blow out preventer is a hollow riser that reaches to, or proximate to, the sea surface.

The seafloor pressure head assembly is comprised of an elongated tube, a pack off head, a stop ring, centralizers, and a re-entry skirt. The elongated tube is typically cylindrical and hollow. Coaxially connected to the top of the elongated tube is the pressure pack off head formed to receive a wireline therethrough. A pressure seal is provided in the pack off head where the wireline enters the pack off head that prevents pressure communication between the inside of the pack off head and the ambient space surrounding the pack off head. The elongated tube bottom is formed to be inserted into the blow out preventer in a way that the inflatable bladder of the blow out preventer circumferentially surrounds the elongated tube along a discrete axial distance. The inflatable bladder surrounds the elongated tube between the wellbore pressure side and the ambient pressure side. When the elongated tube is inserted into the blow out preventer an annulus is formed between the outside of the elongated tube and the inner radius of the blow out preventer.

When the inflatable bladder is inflated it produces an inflated bladder. The inflated bladder circumferentially engages the elongated tube along the discrete axial distance and occupies the portion of the annulus between the elongated tube and the inflatable bladder. Engaging the elongated tube provides a restraining force of sufficient magnitude to attach the elongated tube to the blow out preventer. The inflated bladder also provides a pressure seal in the portion of the annulus between the elongated tube and the inflatable bladder.

Also included in the sea floor pressure head assembly is a stop ring circumferentially attached to the elongated tube high pressure side. The stop ring, which is securedly affixed to the elongated tube, is prevented from traversing across the blow out preventer by contacting the lower edge of the inflated bladder.

A method is provided for eliminating the presence of microannuluses associated with a subsea hydrocarbon producing wellbore for accurate gathering of data within the subsea hydrocarbon producing wellbore. The method involves using a sea floor pressure head assembly in conjunction with a subsea blow out preventer, where the sea floor pressure head assembly includes an elongated tube with a stop ring formed thereon and an ambient pressure side. The blow out preventer is connected to the entrance of the subsea hydrocarbon producing wellbore, and includes an inflatable bladder and is connected to a hollow riser connected thereto.

The method steps involve first inserting a data transmitting wireline coaxially through a sea floor pressure head assembly, then connecting the wireline to a wireline tool. The wireline tool and the sea floor pressure head assembly is then inserted into the riser attached to the blow out preventer and then the sea floor pressure head assembly is lowered into the blow out preventer until the inflatable bladder circumferentially surrounds the elongated tube along a discrete axial distance. The discrete axial distance is located between the stop ring and the ambient pressure side. Inserting the sea floor pressure head assembly into the blow out preventer produces an annulus that is situated between the blow out preventer and the elongated tube.

Next, the inflatable bladder is inflated to produce a seal where the then inflated bladder circumferentially engages the elongated tube along the discrete axial distance which in turn attaches the elongated tube to the blow out preventer. The inflated bladder occupies the portion of the annulus between the elongated tube and the inflatable bladder which provides a pressure seal in the portion of the annulus between the elongated tube and the inflatable bladder.

A pressurized completion fluid is introduced into the hydrocarbon producing wellbore to increase the pressure within the wellbore. This simulates the pressure experienced by the wellbore when the wellbore is filled with a high density drilling fluid. The wireline tool is then traversed through the hydrocarbon producing wellbore for collecting data from within the wellbore.

DETAILED DESCRIPTION OF THE INVENTION

Figure 1:
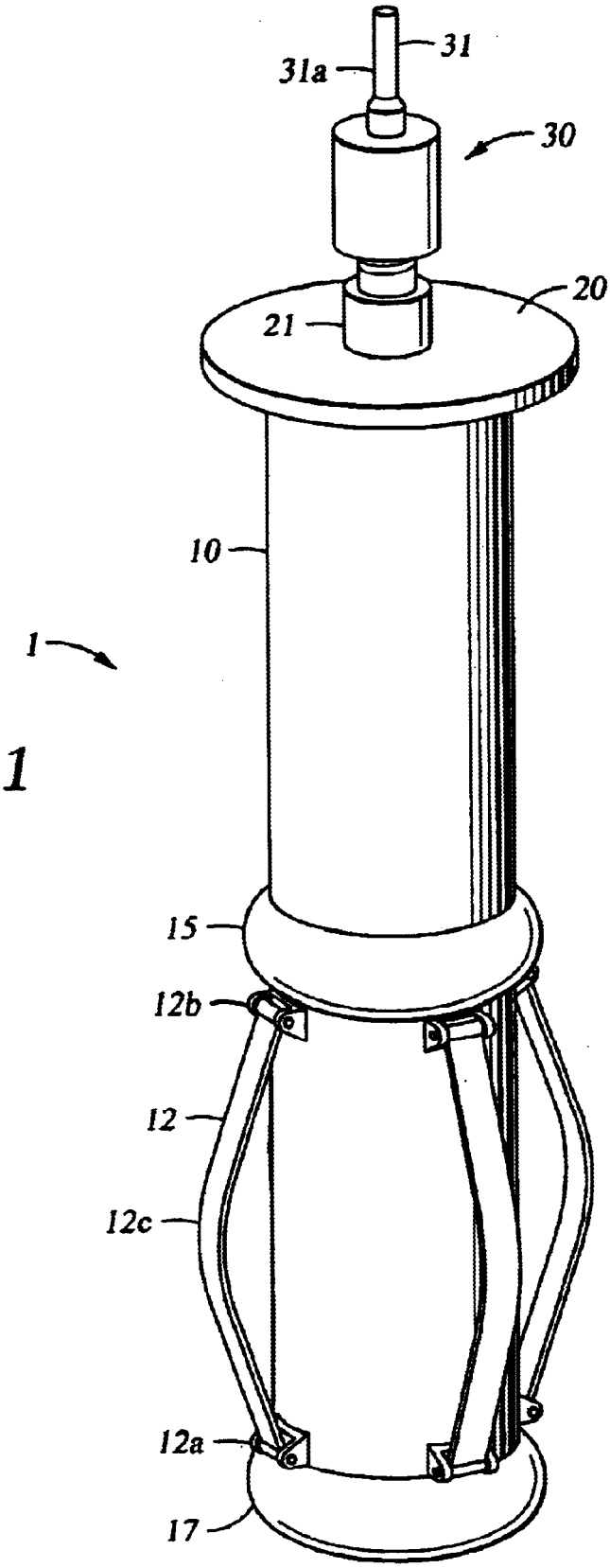
FIG. 1 depicts a side view of the Seafloor Pressure Head Assembly.

One of the primary uses of the present invention occurs below the sea surface, therefore in describing the present invention, the terms "top" and "above" mean closer to the sea surface, whereas the terms "bottom", "beneath", and "below" mean further from the sea surface and therefore closer to the sea floor. With reference to the drawing herein, a seafloor pressure head assembly 1 according to one embodiment of the invention is shown in FIG. 1. The seafloor pressure head assembly 1 typically includes a stinger 10 with a landing flange 20 on one end, a reentry skirt 17 on the other end, a pack off head 30, a stop ring 15, and centralizers 12. Because the invention can be used in a subsea environment, the materials used to fabricate the components must be adequate to withstand the corrosive effects of sea water, production fluids and production gases. Therefore materials such as 4140 steel, or its equivalent, should be used for most of the components. However, engineering judgment should be used to ascertain which material is most suitable for each component.

The seafloor pressure head assembly 1 is positioned onto a well logging tool and lowered into the hydrocarbon producing wellbore (either an oil or gas well) via the wireline that is attached to the well logging tool. The pack off head 30 is fitted with a fishing neck 31 for retrieving the seafloor pressure head assembly 1 from the wellbore should the wireline become detached from the well logging tool. The fishing neck 1 is equipped with right hand threads 31 a so that during retrieval operations a set down overshot retrieval tool (not shown), as is well known in the art, can be backed off the fishing neck 31 without the threat of having portions of the drill string inadvertently disconnect while the drill string is rotated. Th pack off head 30 is preferably screwed onto the collar 21 of the sea floor pressure head assembly 1 by virtue of pipe threads (not shown), but can also be attached by weld or bolt connections.

Figure 4:
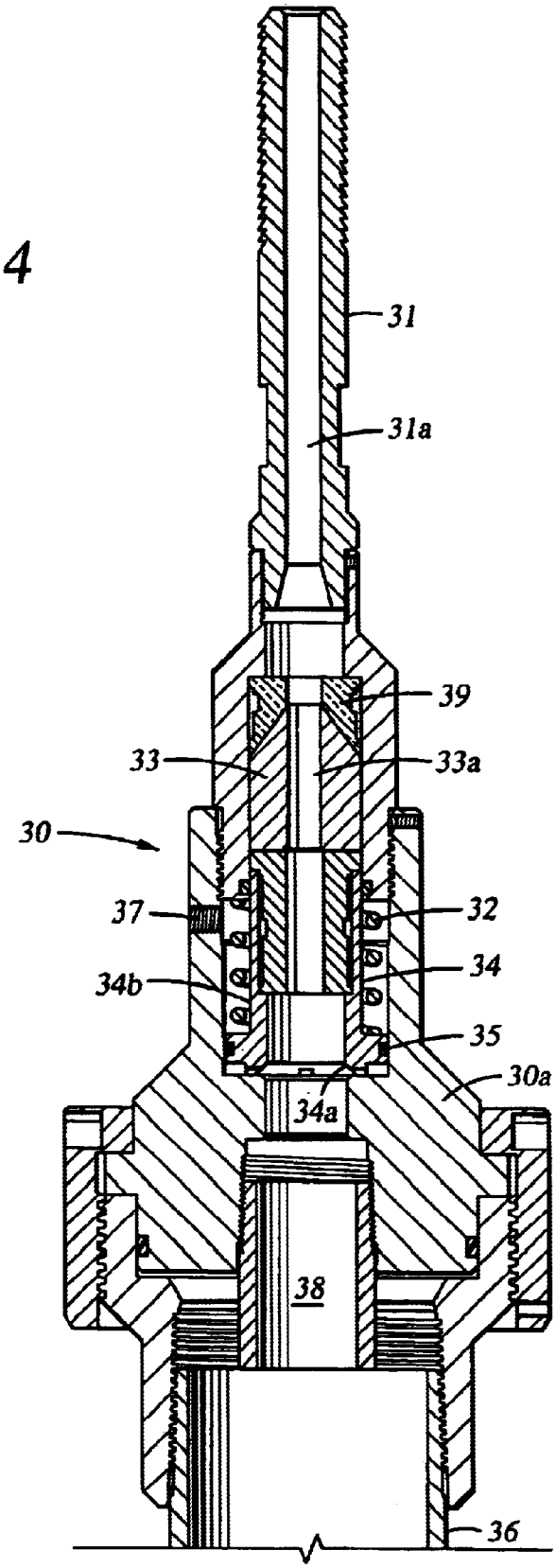
FIG. 4 depicts a cutaway view of a portion of a pack off head.

In FIG. 4, one embodiment of a pack off head 30 utilized with the present invention is depicted which comprises a bushing 39, a pack off rubber 33, a spring 32, a piston 34, a coupling 36, all combined with a body 30*a*. Here, the pack off head 30 can be attached to the sea floor pressure bead assembly 1 by the coupling 36. The body 30*a* forms an annulus in which the piston 3, and the spring 32 are disposed. Above these components are the pack off rubber 33 and the bushing 39. With increased pressure from the wellbore provided to the piston 34 via the pack off head passage 38, the piston 34 squeezes the pack if rubber 33 against the bushing 39 to form a seal around a wireline that may be disposed within the pack off head 30.

Figure 2:
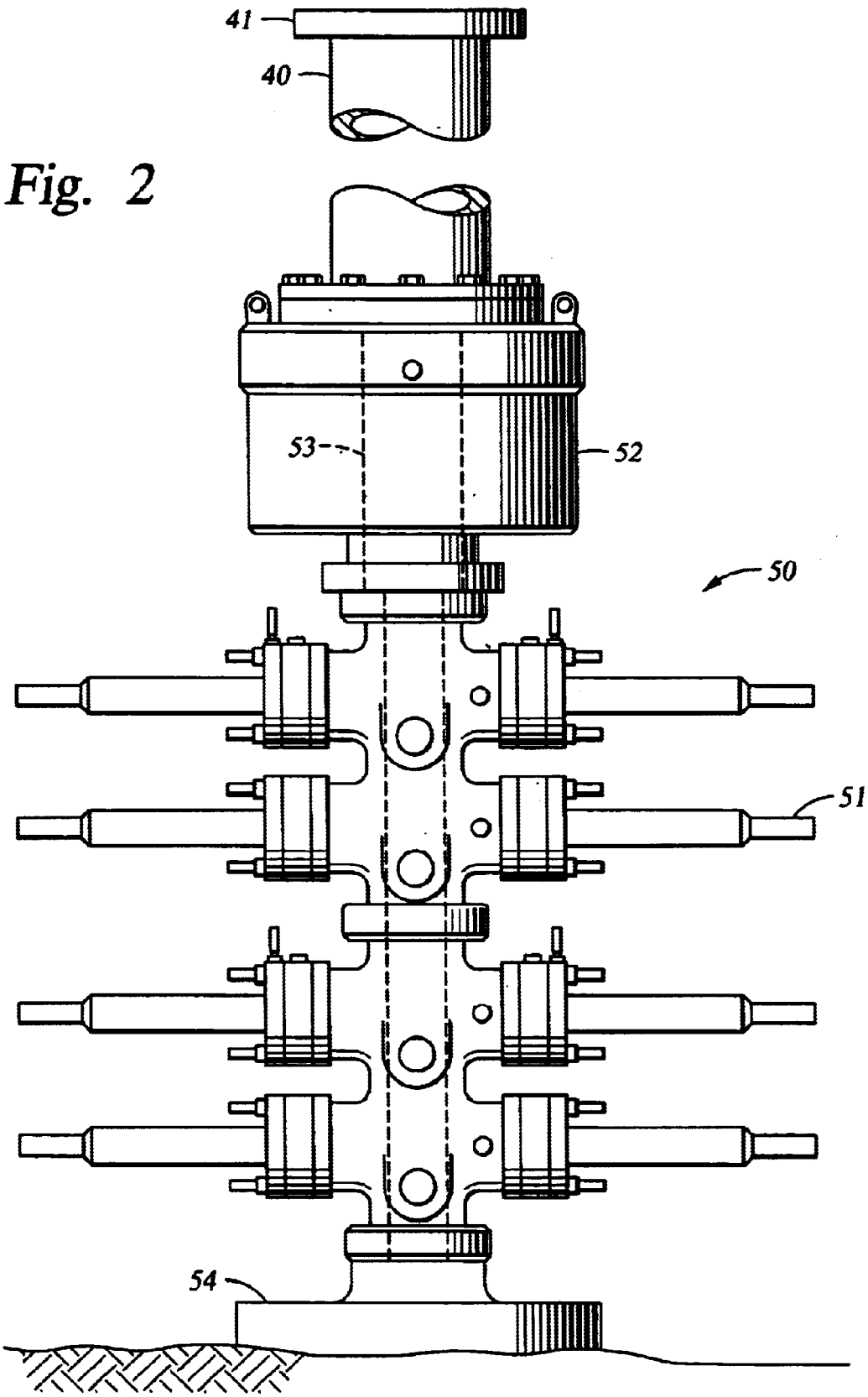
FIG. 2 illustrates a typical subsea blowout preventer with riser.

FIG. 2 illustrates a typical subsea hydrocarbon producing wellbore (an oil or gas well) comprising, a blow out preventer (BOP) 50 situated at the seafloor on top of a hydrocarbon producing wellbore entrance 54. The BOP 50 is comprised of a series of rams 51 and an inflatable bladder sealing portion 52. The rams 51 and the inflatable bladder sealing portion 52 are typical of what exists in the art. The types of rams include pipe rams, blind rams, and shear rams, to name a few. Secured to the top of the BOP 50 is a riser 40 that terminates at the riser flange 41. Because the riser flange 41 should be above the sea surface and inside of a drilling platform or a drilling vessel, the riser 40 will vary in length based on the depth of the BOP 50 beneath the sea surface. Further, based on what operations are being conducted in the well, i.e. drilling, well logging, mechanical services, the riser 40 may or may not have some amount of fluid located within.

During typical use, the sea floor pressure head assembly 1 is installed onto a wireline, after which a well logging tool is attached onto the wireline as is well know in the art. Using the wireline as a tether, the sea floor pressure head assembly 1 and well logging tool are lowered (or tripped) from the sea surface through the riser 40. The centralizers 12 operate to maintain the sea floor pressure head assembly 1 in the center of the riser 40, and to guide the reentry skirt 17 into the BOP 50 via the BOP inner passage 53. The centralizers 12 have a fixed end 12*a* and a free end 12*b*, and a middle portion 12*c*. The radius of the middle portion 12*c* of the centralizers 12 is greater than the radius of the riser 40 inner diameter. Therefore inserting the sea floor pressure head assembly 1 into the riser 40 squeezes the centralizers 12 into a flatter configuration. However the tensile strength of the centralizers 12 forces the middle portion 12*c* back against the riser 40 inner diameter which pushes the stinger 10 away from the riser 40 inner diameter. Accordingly it is important to strategically place the centralizers 12 equidistant apart, and that each centralizer exerts the same outward force to ensure centering the sea floor pressure head assembly 1 within the riser 40.

The sea floor pressure head assembly 1 and well logging tool are lowered into the BOP inner passage 53 until the stop ring 15 has passed beneath the inflatable bladder sealing portion 52. It is important that the stop ring 15 be below the inflatable bladder sealing portion 52 and that the top of the stinger 10 be above the inflatable bladder sealing portion 52—otherwise the proper sealing function of the sea floor pressure head assembly 1 may not be achieved. Inserting the sea floor pressure head assembly 1 into the BOP inner passage 53 forms an annulus between the stinger 10 and the BOP inner passage 53.

After the stop ring 15 has been lowered past the inflatable bladder sealing portion 52, an inflatable bladders 55 that is normally included within the inside of the inflatable bladder sealing portion 52 can be inflated to seal around the outer radius of the stinger 10. The inflatable bladder 55 has a generally toroid shape upon inflation. Inflating the inflatable bladder 55 decreases the inner diameter of the inflatable bladder 55 which envelopes the stinger 10 inside of the inflated bladder 55 along a discrete axial distance. As is typical in the art, the inflatable bladder 55 is inflated with sufficient pressure so as to grasp the stinger 10 with sufficient force to effectively attach the stinger 10 (and thus the sea floor pressure head assembly 1) to the BOP 50.

The inflated bladder 55 not only secures the sea floor pressure head assembly 1 to the BOP 50; but also occupies and provides a pressure seal across the portion of the annulus that exists between the inflatable bladder 55 and aforementioned discrete axial distance of the stinger 10. The pressure seal formed by the bladder allows the wellbore to be pressurized well above the ambient pressure above the wellbore.

The inflatable bladder 55 expands in response to being filled with pressurized fluid. Generally, the pressurized fluid is hydraulic fluid that is introduced into the inflatable bladder 55 by connections (not shown) on the outside of the annular bladder sealing portion 52. The sea floor pressure head assembly 1 is designed such that when the annular inflatable bladder 55 is inflated, the stop ring 15 is situated below the annular bladder sealing portion 52. If an unexpected pressure burst, known in the art as a "well kick", occurs below the sea floor pressure head assembly 1, the presence of the stop ring 15 below inflated annular bladder 55 will prevent the sea floor pressure head assembly 1 from being forced out of the BOP 50. Because the stop ring 15 may contact the annular inflatable bladder 55, either a pressure kick, or if the stop ring 15 is not lowered below the annular bladder 55 by a miscalculation of vertical distance by the wireline operator; it is preferred that the stop ring 15 have a rounder outer circumference instead of sharp or defined edges. However, the stop ring 15 can be comprised of other configurations, such as a square or rounded edge ring, pipe fittings such as unions, a circumferential depressed region on the stinger 10, or a radially extending flange.

Figure 3:
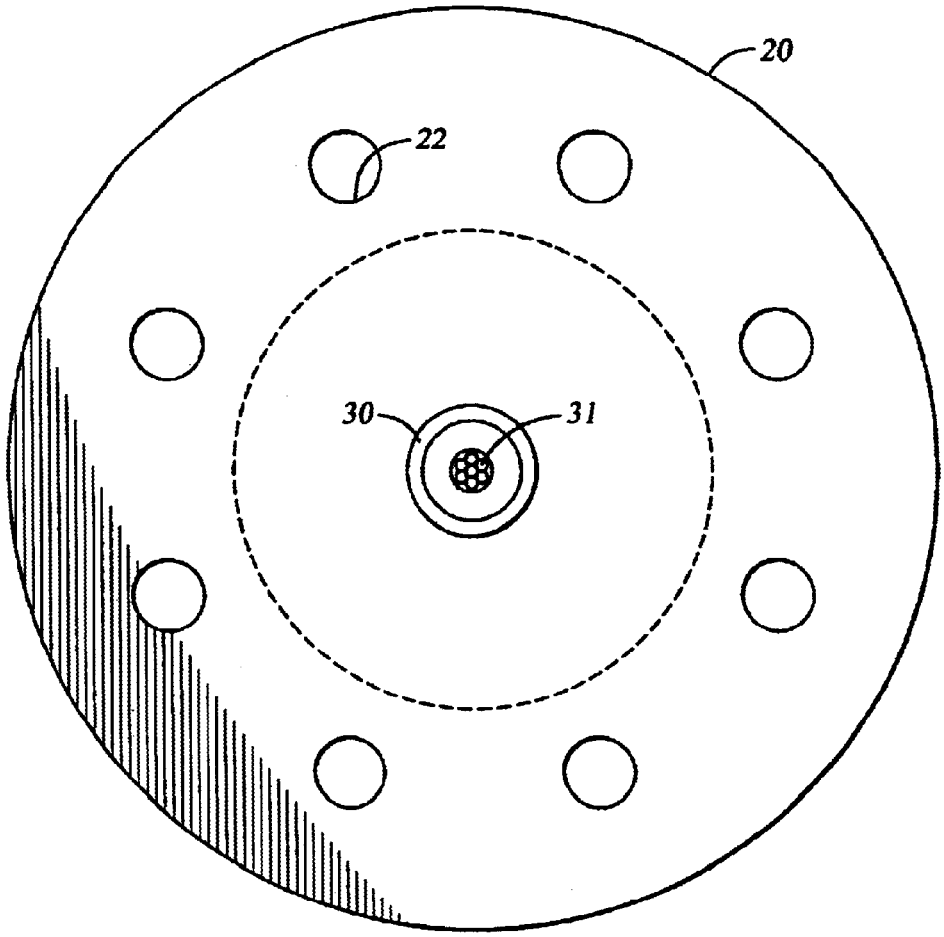
FIG. 3 depicts a top view of the Seafloor Pressure Head Assembly.

The landing flange 20, which is optional, is shown in FIG. 3 attached to the top of the stinger 10 but can be situated anywhere along the upper portion of the stinger 10. The exact location of the landing flange 20 is to be determined by engineering judgment based on the particular application of the sea floor pressure head assembly 1. The diameter of the landing flange 20 should be smaller than the inner diameter of the riser 40 to enable the sea floor pressure head assembly 1 to traverse in and out of the riser 40. However, the diameter of the landing flange 20 should be greater than the diameter of the BOP inner passage 53 so that the landing flange 20 will seat upon the BOP 50 when the sea floor pressure head assembly 1 is lowered into the BOP inner passage 53. The landing flange 20 can be added to ensure that the sea floor pressure head assembly 1 is lowered to the proper location within the BOP 50 thereby reducing the chance for operator error. The landing flange 20 is provided with fluid ports 22 which reduce the weight of the landing flange 20. In the instances when the riser 40 contains fluid, the presence of the fluid ports 22 helps to reduce the pressure drop experienced across the landing flange 20 when the sea floor pressure head assembly 1 travels up and down through the riser 40. The fluid ports 22 should be symmetric about the vertical axis of the sea floor pressure head assembly 1 to help balance the drag forces experienced by the sea floor pressure head assembly 1 as it traverses in and out of the riser 40.

After the sea floor pressure head assembly 1 is secured to the BOP 50, the well operators can begin to perform well logging activities. As noted above, in some well logging procedures such as in cement bond logs, the existence of micro-annulus around the well bore casing can result in incorrect data being recorded. After a well is completed a cement bond log is generally performed to verify the integrity of the cement bond to the casing and the formation. If the bond log results indicate a bonding problem, the pressure inside of the wellbore will be increased and the cement bond log will be re-performed. The wellbore can become pressurized by injecting a completion fluid into the wellbore. Completion fluids can comprise, water, brine, or diesel, and can be pressurized by surface pumps or hydraulic pumps. The pressure in the wellbore is increased to slightly expand the inside of the casing so as to eliminate any surrounding micro-annuluses. If the wellbore is pressurized by completion fluids, the initial pressure is chosen to approximate the wellbore pressure when the higher density drilling fluid occupied the wellbore. Generally, the pressure difference between having a high density drilling fluid in the wellbore versus a lower density completion fluid in the wellbore is approximately 500 pounds per square inch (psi). Therefore, the initial pressure added to the wellbore to attempt to eliminate micro-annuluses is about 500 psi before the second bond log pass is performed.

If the results of the second bond log indicate a problem with the cement bond the pressure in the wellbore will be increased again by increasing the pressure of the completion fluid. After the completion fluid pressure is increased subsequent bond logs will be performed. However, the pressure in the wellbore generally is not allowed to exceed 1000 psi. Should the cement bond log produce a favorable result, i.e. that the cement has adequately bonded to the casing and formation, well operations will proceed to other activities. Conversely, if the wellbore pressure reaches or exceeds 1000 psi, and the cement bond logs still do not yield favorable results, there is most likely a cement bonding problem that may or may not need to be repaired. The decision to repair the bonding problem is left to the well operator. It is important that the cement bond properly to the pipe and formation, otherwise the hydrocarbons produced by the well may be contaminated with undesirable water or gas from other geological formations adjacent to the zone of interest.

Micro-annuluses between the casing and the cement sheath can alternatively be eliminated by filling the borehole with high density fluid such as drilling mud, which equalizes the pressure between the inside of the casing and the cement sheath. This is not always desirable since the effectiveness of some well logging tools is reduced by the presence of a high density fluid in the well bore.

When using the sea floor pressure head assembly 1, the stinger 10 is sealed off by the annular bladder, and the wireline is sealed by the pack off head 30; installation of the sea floor pressure head assembly 1 enables the wellbore to be pressurized without unacceptable leakage emanating from the well bore. After the wellbore has been pressurized to a suitable pressure such as 500 psi–1,500 psi, and any micro-annuluses have been eliminated, well logging procedures can be performed that are sensitive to the presence of micro-annuluses.

When wireline operations are completed and it is desired to raise the wireline tool and sea floor pressure head assembly 1 from the borehole, the wireline tool is raised up inside of the sea floor pressure head assembly 1. The reentry skirt 17 helps to guide the wireline tool up into the stinger 10 and prevents the wireline tool from becoming snagged on the bottom of the stinger 10 during reentry.

Figure 5:
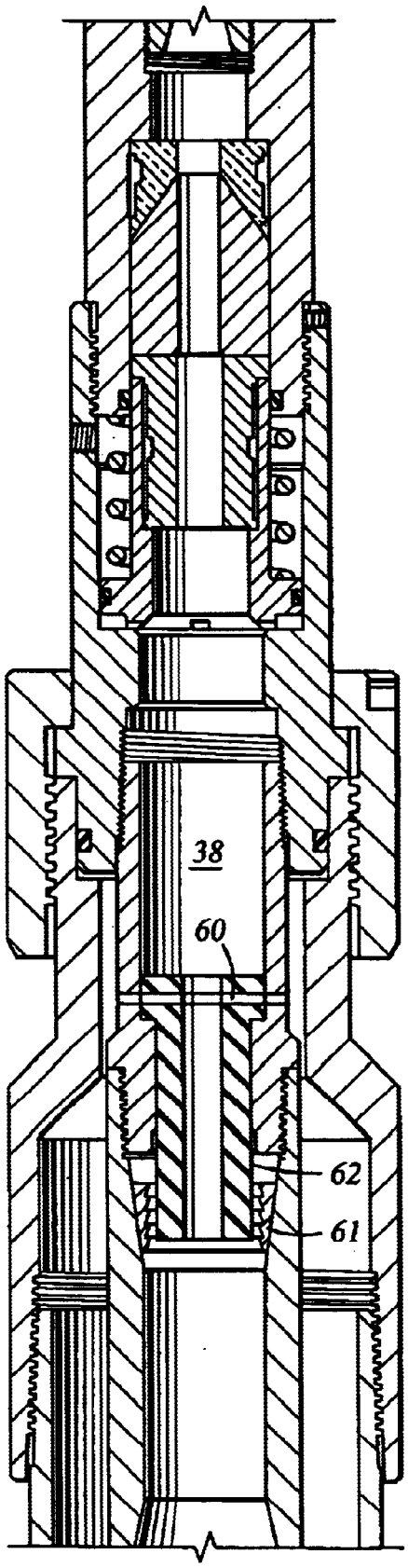
FIG. 5 depicts a cutaway view of a portion of a pack off head including a shank catcher.
Figure 6:
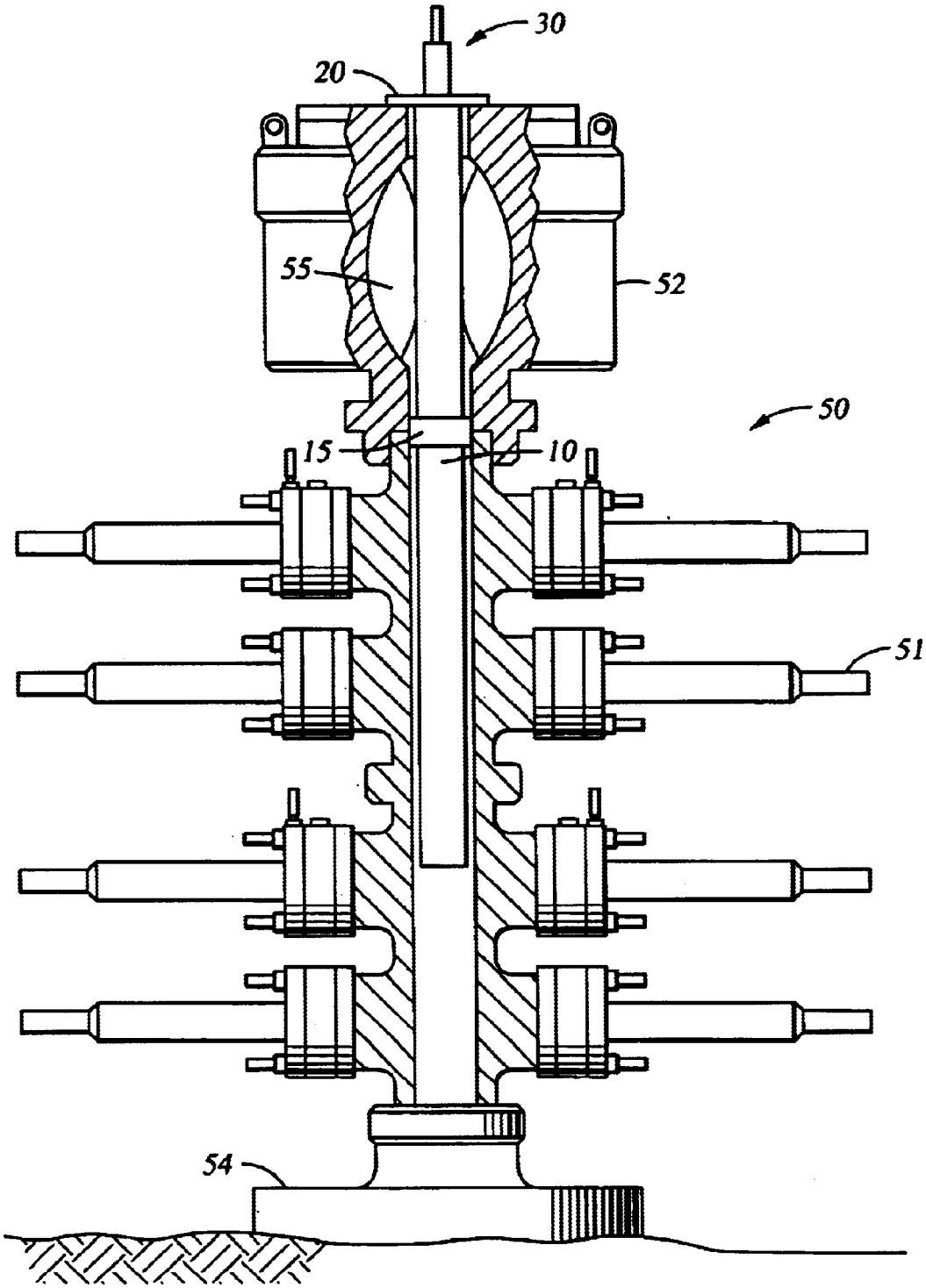
FIG. 6 illustrates a partial cutaway view of a blow out preventer combined with one embodiment of the present invention.

Another novel aspect of the present invention is the shank catcher feature illustrated in FIG. 5. The shank catcher is designed to capture a wireline tool should the wireline operator lift the wireline tool too quickly from the borehole and collide with the pressure pack off head 30. If a wireline tool is forced up against the pressure pack off head 30, the wireline tool will impact the catcher bushing 62; if sufficient for is applied by the wireline tool, the catcher bushing 62 will be forced upwards towards the pack head passage 38 thereby fracturing the shear pin 60. If the upper portion of the wireline tool is fitted with an appropriate fitting, such as the fishing neck 31 of the pressure pack off head 30, the catcher slips 61 can grasp the wireline tool fitting after the catcher bushing 62 has been moved fully upward and no longer obstructs the grasping operation of the catcher slips 61.

Grappling the wireline tool by the catcher slips 61 attaches the wireline tool to the sea floor pressure head assembly 1. Then both the tool and assembly can be retrieved with a conventional fishing tool by attaching to the fishing neck 31. The shank catcher can also be utilized should the sea floor pressure head assembly 1 become stuck and it become impossible to raise the sea floor pressure head assembly 1 to the sea surface without exceeding the yield strength of the wireline. In that case the operator would purposefully force the wireline tool up against the pressure pack off head 30 to fracture the shear pin 60 to have the catcher slips 61 engage the wireline tool. If the wireline has not already been separated from the wireline tool, a greater force is applied to the wireline to pull it free from the wireline tool. After the wireline is retrieved from the wellbore, conventional retrieval techniques can be employed to capture and remove the sea floor pressure head assembly 1, with the attached wireline tool, from the wellbore.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. For example the invention can be used as an additional safety measure for any wireline procedure, such as perforations and plug setting, These and other similar modifications will readily suggest themselves to those skilled in the art, and are intended to be encompassed within the spirit of the present invention disclosed herein and the scope of the appended claims.

What is claimed is:

1. A seafloor pressure head assembly for use in hydrocarbon producing wellbore wireline operations in combination with a blow out preventer located at the entrance to a subsea hydrocarbon producing wellbore, the low out preventer having an inflatable bladder formed within its axial inner passage, and a hollow riser attached thereto, said combination comprising:

a pressure pack off head having a low pressure side, a high pressure side, and an axial passage formed therein;

wherein said axial passage is adapted to provide for wireline passage therethrough;

wherein a sealing contact is formed between said axial passage and a wireline passed therethrough to prevent pressure communication between said high pressure side and said low pressure side along the wireline;

an elongated tube having a top, a bottom, an inside, an outer surface, a wellbore pressure side and an ambient pressure side, connected at its top to said pressure pack off head, such that it is coaxial with said pressure pack off head;

wherein said elongated tube bottom is formed for insertion of the elongated tube into the blow out preventer such that the inflatable bladder of the blow out preventer circumferentially surrounds said elongated tube along discrete axial distance between said wellbore pressure side and said ambient pressure side, wherein inserting said elongated tube into the blow out preventer forms an annulus between said elongated and the blow out preventer;

wherein upon inflation of the inflatable bladder produces an inflated bladder which circumferentially engages said elongated tube along the discrete axial distance and occupies the portion of the annulus between said elongated tube and the inflatable bladder, thereby providing a restraining force onto said elongated tube, whereby the restraining force is of sufficient magnitude to attach said elongated tube to the blow out preventer, and thereby providing a seal in the portion of the annulus between said elongated tube and the inflatable bladder; and a stop ring circumferentially attached to said elongated tube high pressure side, wherein the presence of the inflated bladder prevents the stop ring from axially traversing through the blow out preventer.

2. The sea floor pressure head assembly of claim 1 further comprising a landing flange on the high pressure side thereof formed to be seated upon said blow out preventer to accurately place the sealing surface of the elongated tube across the inflatable bladder.

3. The sea floor pressure head assembly of claim 1 wherein the pressure pack off head is formed with a fishing neck adapted to provide for an attachment means for retrieving the sea floor pressure head assembly from inside of a wellbore.

4. The sea floor pressure head assembly of claim 1 further providing a shank catcher, wherein said shank catcher provides a means for grappling a wireline tool from the inside of a wellbore.

5. The sea floor pressure head assembly of claim 1 further providing an outwardly extending skirt attached to the bottom end of said elongated tube, wherein said skirt facilitates guiding a wireline tool into the inside of said elongated tube.

6. The sea floor pressure head assembly of claim 1 further providing a means for centralizing the sea floor pressure head assembly within the riser.

7. The sea floor pressure head assembly of claim 6 wherein said means are comprised of a series of radially extending flexible bands that exert a substantially equal force between said elongated tube and riser so as to centralize said sea floor pressure head assembly within the riser.

8. The sea floor pressure head assembly of claim 2 wherein said radial flange extends past the outer radius of said elongated tube to form a ledge for mating with the opening of the blow out preventer.

9. The sea floor pressure head assembly of claim 1, wherein said stop ring is selected from the group consisting of a pipe union, a radial flange, a rounded ring, a toroid ring, and a square edged ring.

10. A method of eliminating the presence of microannuluses associated with a subsea hydrocarbon producing wellbore for accurate gathering of data within the subsea hydrocarbon producing wellbore, using a sea floor pressure head assembly having an elongated tube with a stop ring formed thereon and an ambient pressure side, in conjunction with a subsea blow out preventer, wherein the blow out preventer is connected to the entrance of the subsea hydrocarbon producing wellbore, the blow out preventer having an inflatable bladder formed therein and has a hollow riser connected thereto, comprising the steps of:

inserting a wireline coaxially through a sea floor pressure head assembly, wherein the wireline transmits data;

connecting the wireline to a wireline tool;

inserting the wireline tool an said sea floor pressure head assembly into the riser attached to the blow out preventer;

lowering said sea floor pressure head assembly into said blow out preventer until said inflatable bladder circumferentially surrounds said elongated tube along a discrete axial distance between said stop ring and said ambient pressure side, wherein inserting said sea floor pressure head assembly into the blow out preventer produces an annulus situated between the blow out preventer and said elongated tube;

inflating the inflatable bladder to produce an inflated bladder wherein the inflated bladder circumferentially engages said elongated tube along said discrete axial distance thereby attaching said elongated tube to the blow out preventer, wherein said inflated bladder occupies the portion of the annulus between said elongated tube and the inflatable bladder thereby providing a pressure seal in the portion of the annulus between said elongated tube and the inflatable bladder;

introducing a pressurized completion fluid into the hydrocarbon producing wellbore to increase the pressure within the wellbore to simulate the pressure experienced by the wellbore when the wellbore is filled with a high density drilling fluid; and traversing the wireline tool through the hydrocarbon producing wellbore and collecting data from within the wellbore wherein said sea floor pressure head assembly comprises, a pressure pack off head having a low pressure side, a high pressure side, and an axial passage formed therein, wherein said axial passage is adapted to provide for wireline passage therethrough wherein a sealing contact is formed between said axial passage and a wireline passed therethrough to prevent pressure communication between said high pressure side and said low pressure side along the wireline, an elongated tube having a top side, a bottom side, an inside, an outer surface, a wellbore pressure side and an ambient pressure side, and is connected at its top side to said pressure pack off head, whereby said elongated tube bottom side is formed for insertion into the blow out preventer, and a stop ring circumferentially attached to said elongated tube high pressure side for preventing axial displacement of said elongate tube.

11. The method of claim 10, further comprising properly spacing said elongated tube in the blow out preventer by forming at landing flange to the high pressure side of said sea floor pressure head assembly for positively placing the sealing surface of said elongated tube across the inflatable bladder.

12. The method of claim 10, wherein the wireline procedure is selected from the group consisting of cement bond logs, well bore perforations, neutron logs, and plug setting.

13. A seafloor pressure head assembly for use with a blow out preventer that includes an inflatable bladder disposed therein, comprising:

an elongated tube sealable on one end; and a stop ring attached to said elongated tube;

wherein when said bladder circumscribes at least a portion of said elongated tube and wherein when said bladder is inflated, said bladder is capable of providing a seal around said elongated tube.

14. The seafloor pressure head assembly of claim 13, wherein said circumferential seal provided by said bladder is above said stop ring.

15. The seafloor pressure head assembly of claim 13 wherein the presence of the bladder coaxially circumscribing said elongated tube is capable of providing a stopping force onto said stop ring.

16. The seafloor pressure head assembly of claim 13 further comprising at least one centralizer disposed on the outer surface of said elongated tube.

17. The seafloor pressure head assembly of claim 13 further comprising a landing flange.

18. The seafloor pressure head assembly of claim 13 further comprising a pressure pack off head disposed on said elongated tube.

19. The seafloor pressure head assembly of claim 13 further comprising a shank catcher disposed on said elongated tube.

20. The seafloor pressure head assembly of claim 13 further comprising a skirt disposed on one end of said elongated tube.

21. A method of using a sea floor pressure head assembly comprising:

lowering the sea floor pressure head assembly within a wellbore having a blow out preventer, wherein said sea floor pressure head assembly comprises an elongated tube having a stop ring disposed thereon, and the blowout preventer includes an inflatable bladder capable of circumscribing said elongated tube;

disposing said stop ring below said bladder; and inflating said bladder thereby providing a sealing surface between the bladder and where it contacts said elongated tube.

22. The method of claim 21 further comprising securing a pressure pack off head on said elongated tube and disposing a wireline through said pressure pack off head.

23. The method of claim 22 further comprising pressurizing said wellbore to a selected pressure.

24. The method of claim 22 further comprising attaching a downhole tool to the wireline capable of monitoring wellbore conditions and running the downhole tool within the pressurized wellbore to perform a wireline procedure.

25. The method of claim 22 wherein the wireline procedure is selected from the group consisting of cement bond logs, well bore perforations, neutron logs, and plug setting.

26. The method of claim 22 further comprising providing a landing flange on said elongated tube formed to seat proximate to the top of the blow out preventer.

27. The method of claim 26 further comprising disposing said stop ring on said elongated tube such that when said landing flange contacts the blowout preventer, said stop ring is situated below the bladder.

* * * * *